United States Patent [19]

Schuster et al.

[11] 4,333,307

[45] Jun. 8, 1982

[54] FRICTION ROTOR

[75] Inventors: Friedrich Schuster; Hans Hermanns, both of Hammelburg, Fed. Rep. of Germany

[73] Assignee: Kugelfischer Georg Schafer & Co., Scheinfurt, Fed. Rep. of Germany

[21] Appl. No.: 934,538

[22] Filed: Aug. 17, 1978

Related U.S. Application Data

[63] Continuation of Ser. No. 611,859, Sep. 10, 1975, abandoned.

[30] Foreign Application Priority Data

Sep. 10, 1974 [DE] Fed. Rep. of Germany ..... 2443238

[51] Int. Cl.[3] ..... D02G 1/04; D02G 1/08

[52] U.S. Cl. ..... 57/334; 57/337; 57/341

[58] Field of Search ..... 57/2, 337, 334, 1 R, 57/341, 284, 332; 428/323

[56] References Cited

U.S. PATENT DOCUMENTS

| | | | |
|---|---|---|---|
| 3,537,250 | 11/1970 | Mackintosh | 57/332 |
| 3,831,360 | 8/1974 | Horvath | 57/284 X |
| 3,936,577 | 2/1976 | Christini et al. | 428/323 X |

FOREIGN PATENT DOCUMENTS

| | | |
|---|---|---|
| 2052298 | 4/1972 | Fed. Rep. of Germany . |
| 1083052 | 9/1967 | United Kingdom . |

OTHER PUBLICATIONS

W. F. Sharp; "Properties and Applications of Composite Diamond Coatings"; May, 1974; pp. 1–13.

*Primary Examiner*—John Petrakes
*Attorney, Agent, or Firm*—Bacon & Thomas

[57] ABSTRACT

A friction rotor for false-twisting threads is provided with a coating of particles which are harder than the material from which the rotor has been made to provide a surface of harder particles which contact the thread as it passes over the rotor for false-twisting.

6 Claims, 2 Drawing Figures

FRICTION ROTOR

Figure 1:
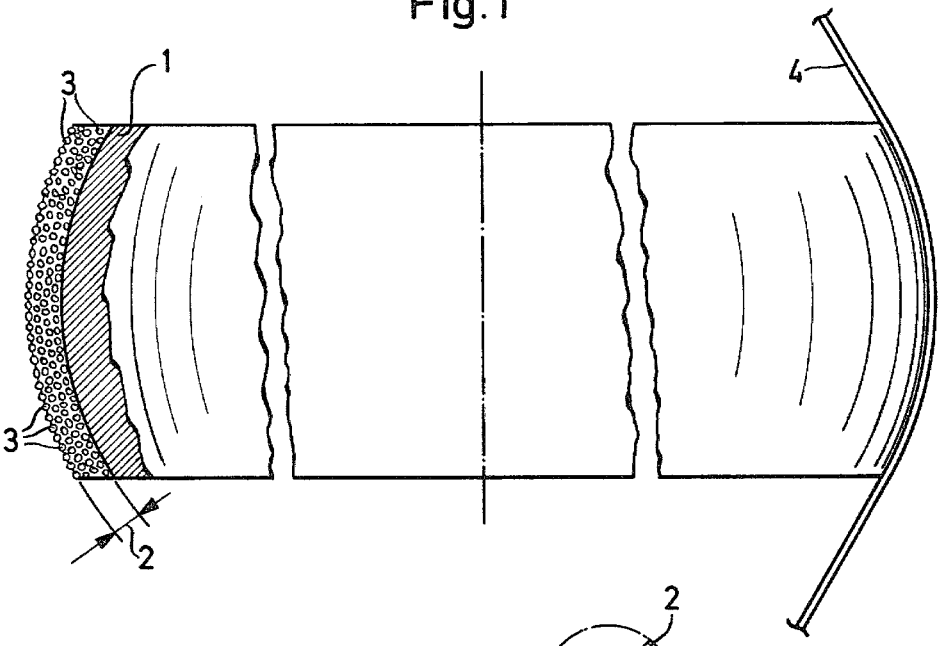

This is a continuation of application Ser. No. 611,859 filed Sept. 10, 1975, now abandoned.

This invention relates to a friction rotor for friction-false-twisting of threads, in particular for crimping synthetic threads.

It is known, in order to false-twist threads, to allow them to roll for example on friction discs or in friction sleeves. A multitude of relevant devices are already within the state of the art.

The friction discs are for example arranged on three rotatably mounted spindles which, in plan view, lie at the corners of an equilateral triangle. Each spindle is provided with at least one disc and the thread which is to be false-twisted follows a zig-zag path between the discs.

In the case of friction sleeves the thread to be false-twisted is passed through the sleeve in order to be in rolling contact either with the whole of the inner surface of its bore or only in the region of its two ends.

Friction discs have a surface for contact with the thread to be false-twisted, i.e., at the periphery, made of a material having a suitably high co-efficient of friction and having a predetermined known hardness and elasticity, generally a polyurethane. Likewise, in friction sleeves the, or each, surface in contact with the thread is made of such material.

Friction discs and sleeves are subjected to relatively high loading at the thread contact surface as the thread to be false-twisted runs across the surface at a very high speed. A relatively high degree of wear is found where the elastic material is present. This results in the necessity for frequent replacement of the rotors, i.e., friction discs or sleeves, which are expensive. The down-time involved in the replacement of the rotor also has to be taken into account when assessing the cost.

In order to avoid excessive heating by the insufficient conduction away of heat generated by friction between the thread and the thread contact surfaces, and thereby damage to the thread and also to the thread contact surfaces, and furthermore to keep within limits the scratching and wear of the thread contact surfaces, it is known, in friction sleeves, to provide a coating of a friction material, preferably polyurethane, at the thread contact surfaces, this coating being not thicker than 2 mm and having at room temperature a Shore hardness of more than 30 (DT-OS No. 2 311 172).

Also there are known ceramic coated friction discs for friction-false-twisting threads, which have a longer working life than discs having thread contact surfaces made of polyurethane. The ceramic coating is applied by flame-spraying, which involves high temperatures and pressures. The supporting surface which is to carry the coating must therefore be correspondingly resistant. Also it is a drawback that no accurate control of the surface characteristics is possible as in particular the spacing of the individual grains of powder cannot be accurately controlled. Moreover, the thread contact surfaces can become coated relatively easily with brightener residues as sharp recesses are present which become filled with oily powder. These filled recesses are then centers for further deposits which can make the disc roughness ineffective. Furthermore, when the roughness that has been produced is worn away the useful life of the disc is at an end.

In order to increase the resistance of the thread, which is to be false-twisted, to breakage and to achieve uniform false-twist quality from one apparatus to another and also throughout the working life of one and the same apparatus, it is known in friction rotors, in particular in friction sleeves, to provide on the thread contact surface a polished material having a coefficient of friction which is below 0.5 and having a high degree of hardness, preferably more than 60 Rockwell, and which is practically non-resilient, namely preferably a ceramic material having a high content of sintered titanium or aluminium oxide, possibly also chromium steel or glass (DT-OS No. 2 305 871).

Finally, within the state of the art it has been proposed to subject threads to a kind of grinding process in which the thread in question is taken past a rotating grinding surface (French-PS No. 1 418 768). For the continuous production of crimped staple fiber bodies of bundled threads of thermoplastic material the highly twisted bundle of threads passing through a false-twisting apparatus is brought in its highly twisted condition into contact with grinding and cutting members, for example, the thread or thread bundle is drawn from a supply spool and fed past a heating element, allowed to run through a rotating sleeve at the thread exit end of which a twist-imparting device has the thread or thread bundle passing round it and at the thread entry end an annular bead is provided with a coating of grinding medium or with cutting ribs or edges. The thread or thread bundle runs over the bead so that all the individual threads which come in turn to the surface of the thread or bundle are cut through and then according to the number of individual fibers, the thread gauge and the degree of twist, one obtains staple fibers having a length of about 30 to 100 mm (DT-OS No. 2 249 947).

In the crimping of synthetic threads, imparting the twist to the thread by means of this grinding or cutting method runs contrary to the aim of treating the thread if possible with a finishing or improving action and accordingly, on account of the damage to the thread, this method has not been contemplated up to now.

It is therefore an object of this invention to provide a friction rotor of the kind described above which has a high resistance to wear at the thread contact surfaces, and which is easy and cheap to manufacture and indeed has accurately repeatable contact surface characteristics, so that the thread in question is given a good finishing treatment.

Figure 2:
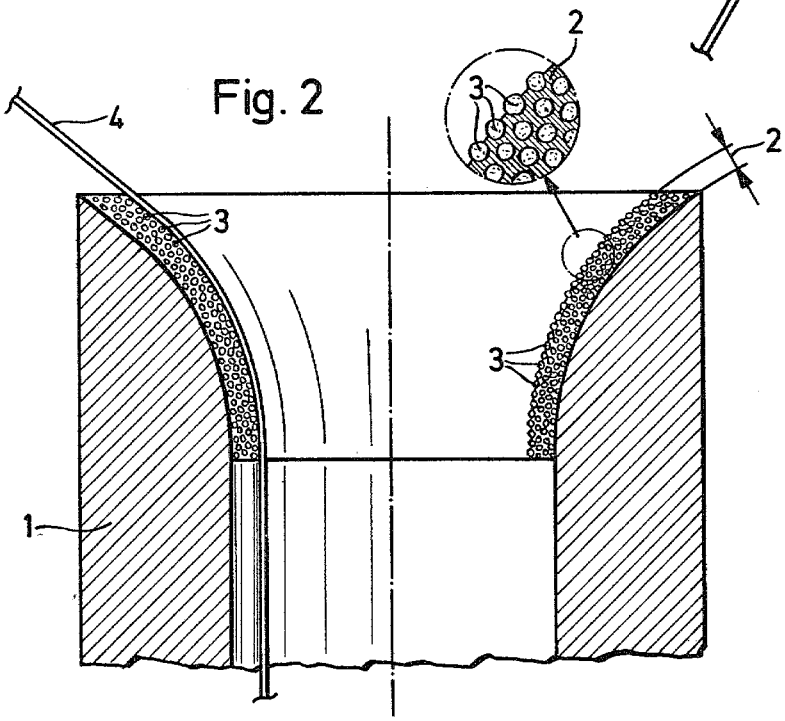

Other objects will become apparent from the following description with reference to the accompanying drawing wherein FIG. 1 is a side elevation, partially in longitudinal section, of an embodiment of a friction disc provided by the invention; and FIG. 2 is a part of an axial section through a friction sleeve provided by the invention.

The foregoing objects and others are accomplished in accordance with this invention, generally speaking, by providing a friction rotor for friction false-twisting of threads, in particular for crimping synthetic threads, in which the thread contact surface is provided with a coating having embedded wart-like outwardly projecting hard particles of roughly uniform grain size at the thread contact surface.

Preferably, the coating of the friction rotor provided by the invention is a relatively soft nickel matrix in which small hard particles, in particular diamonds, and in fact, preferably synthetic diamonds having a polycrystalline structure and relatively rounded form, are embedded. The coating is conveniently applied by immersing the carrier or support of the friction rotor in a heated nickel boron bath in which the small hard particles are suspended.

The carrier or support may be made of any metal or any synthetic resin which is resistant to those temperatures which are necessary for the application of the coating with embedded particles in the heated nickel boron bath.

The characteristics of this coating surface are capable of being controlled accurately and are therefore capable of being repeated and in fact the particle density on the coating surface is controllable by the volume fraction of particles in the bath, and the size of the warts by the size of the particles put into the bath. Into the bath in question we put particles which all have substantially the same mean diameter. Depending upon the type of yarn or thread which is to be treated by the friction rotors, the mean diameter of the particles is chosen to be between 2 and 20 microns. The particles in the surface coating preferably are spaced from each other a distance less than the diameter of the thread whereby the thread contacts only the particles as it passes over the rotor.

The characteristics of the friction rotor according to the invention at the thread contact surfaces can therefore be arranged to match the characteristics of the thread in question which is to be false-twisted so that optimum results can be obtained in the friction false-twisting operation. The friction rotors according to the invention have a very high degree of resistance to wear. The extraordinarily long working life is also favored by the fact that after the relatively soft nickel layer in which the hard particles are embedded has worn away the particles which project the furthest fly off and further unworn particles which lie below them are brought to the surface. Thus, the original surface quality is maintained. Thus, automatic regeneration of the thread contact surface takes place.

Referring to FIG. 1 a disc-shaped carrier 1 has applied to its periphery a coating 2 which has embedded in it synthetic diamonds 3 of polycrystalline structure and relatively rounded shape. The diamonds 3 have a roughly uniform means diameter. The mean particle diameter can lie between 2 and 20 microns according to the type of thread or yarn. The diamonds 3 are mechanically held embedded in the coating 2 and project like warts and in fact project to a greater or lesser extent within close limits. The coating 2 includes in addition to the diamonds 3 some metal, preferably a nickel alloy, and is applied in the following manner. The coating of the friction rotor is produced by immersing the carrier 1 of metal or a plastics material capable of standing up to about 100° C. in a nickel boron bath in which the synthetic diamonds are suspended. After the desired coating has been formed the carrier 1 is removed from the bath and the nickel matrix in which the particles are embedded is hardened and tempered. Then there follows a blasting or spraying step with a suitable powder in order to remove loose particles. The result is a relatively smooth surface with wart-like bumps.

Referring to FIG. 2, the support 1 is in the form of a sleeve of which both open ends are rounded off. At each rounded-off end there is provided a coating 2 having embedded diamonds 3 which project outwards like warts. The friction disc as shown in FIG. 1 and the friction sleeve shown in FIG. 2 therefore has on that surface or those surfaces which the thread 4 to be false-twisted engages the rolls upon, an extremely high resistance to wear. Despite the hardness of the diamonds 3 and accordingly the lack of elasticity at the thread contact surface and its roughness, it is found that surprisingly an effective false-twist can be attained in the thread 4 without the thread being excessively loaded, although one would actually have expected that the projecting diamonds would cause a high degree of abrasion of the thread. Additionally, there is the advantage that there are no pores present at the thread contact surface and so contamination by brightener is not possible.

As shown in FIGS. 1 and 2, the coating 2 comprises not only an outer layer of diamonds 3 but in addition to the outer layer of diamonds 3 which project partially outwards and form wart-like projections or bumps, there are still more inwardly succeeding layers of completely embedded diamonds 3 which become effective in turn as soon as the nickel alloy present between the diamonds 3 has worn away by a corresponding amount and the diamonds 3 of the then outer layer drop away. There is therefore automatic regeneration of the surface of the coating and the characteristics of the thread contact surface or surfaces are maintained. This gives a significant additional improvement in the working life of the friction rotors according to the invention.

The invention is not limited to the use of diamonds as hard particles. Generally speaking, any particles may be used having a hardness between 7 and 10 according to the Mohs' hardness scale.

Although the invention has been described in detail for the purposes of illustration, it is to be understood that such detail is provided solely for that purpose and that variations can be made therein by those skilled in the art without departing from the spirit and scope of the invention.

What is claimed is:

1. A friction rotor for false-twisting thread having a surface coating which is contacted by thread as the thread is false-twisted, said coating being more wear resistant than an uncoated area of the rotor, said coating comprising a metal layer having diamonds of relatively rounded form and with a substantially uniform mean diameter in the range of from 2 to 20 microns substantially uniformly dispersed throughout said layer and projecting outwardly from the surface of the coating in a wart-like substantially uniform manner, said metal layer being less wear resistant than the diamonds, the volume fraction of the diamonds in said coating and the size of said diamonds being correlated to match the characteristics of a thread to be false-twisted so as to provide an effective friction false-twisting operation, said surface having been finished to provide a relatively smooth surface while retaining the necessary friction characteristics to impart an effective false-twist to said thread without the thread being excessively loaded.

2. A friction rotor according to claim 1 in which the coating, apart from the embedded diamonds, comprises a nickel alloy.

3. A friction rotor according to claim 2 in which said nickel alloy is a hardened and tempered nickelboron alloy.

4. A friction rotor according to claim 1 in which the diamonds are synthetic diamonds with a polycrystalline structure.

5. A friction rotor according to claim 1 in which the coating is on a support of metal or synthetic resin.

6. A friction rotor according to claim 1 in which said diamonds are spaced from each other a distance less than the diameter of the thread whereby the thread contacts substantially only the diamonds as it passes over the rotor.

* * * * *